US006575769B1

(12) United States Patent
Takeuchi et al.

(10) Patent No.: US 6,575,769 B1
(45) Date of Patent: Jun. 10, 2003

(54) MOLDED CONNECTOR AND METHOD OF PRODUCING THE SAME

(75) Inventors: Masayuki Takeuchi, Tokyo (JP); Hiroshi Matsumiya, Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/514,157

(22) Filed: Feb. 28, 2000

(30) Foreign Application Priority Data

Mar. 10, 1999 (JP) ..... 11-063057

(51) Int. Cl.[7] ..... H01R 12/00
(52) U.S. Cl. ..... 439/74; 439/931
(58) Field of Search ..... 439/74, 874, 736, 439/660, 722, 883, 604, 606, 769, 931; 29/883, 884, 722, 842, 848

(56) References Cited

U.S. PATENT DOCUMENTS 3,638,166 A * 1/1972 Steipe ..... 439/660
3,915,537 A * 10/1975 Harris et al. ..... 439/249
4,087,655 A * 5/1978 Massey ..... 439/736
4,501,465 A * 2/1985 Hoshino et al. ..... 439/736
4,912,772 A * 3/1990 Beaudry ..... 361/791
5,154,621 A * 10/1992 Legrady ..... 439/82
5,557,286 A * 9/1996 Ikesugi et al. ..... 439/74
5,590,463 A * 1/1997 Fedman ..... 439/736
5,772,474 A * 6/1998 Yagi et al. ..... 439/660
6,010,370 A * 1/2000 Aibara et al. ..... 439/660
6,019,613 A * 2/2000 Kataoka et al. ..... 439/83

FOREIGN PATENT DOCUMENTS

JP 2-297880 12/1990
JP 3-173080 7/1991

* cited by examiner

*Primary Examiner*—Jean F. Duverne
(74) *Attorney, Agent, or Firm*—Staas & Halsey LLP

(57) ABSTRACT

A connector comprising an electrically insulating body, and at least one contact element provided in the electrically insulating body. The contact element includes a protrusion integrally formed on the electrically insulating body and an electrically conducting layer deposited on a surface of the protrusion. The contact element is fixedly supported at opposite ends thereof on the electrically insulating body to exert elasticity or a spring action. The connector is produced by molding a primarily molded body including at least one protrusion, molding a secondarily molded body on the primarily molded body to form the electrically insulating body in such a manner as to partially cover the primarily molded body except for the surface of the protrusion, and depositing the electrically conducting layer on the surface of the protrusion.

13 Claims, 6 Drawing Sheets

MOLDED CONNECTOR AND METHOD OF PRODUCING THE SAME

BACKGROUND OF THE INVENTION

1. Field of the Invention

The present invention relates to an electrical connecting device and, more particularly, to a connector including a protrusion integrally formed on an electrically insulating body, the protrusion being deposited with an electrically conducting layer to constitute a contact element.

2. Description of the Related Art

In recent years, electronic equipment, as well as various types of electronic parts incorporated therein, have been required to be reduced in the dimensions and weight thereof. According to such requirements, for example, board connectors, used for electrically connecting a pair of circuit boards with each other, have been made with narrow pitches of the array of contact elements incorporated therein, in order to reduce the areas to be occupied on the circuit board or to increase the density of lines provided thereon.

In a conventional connector which includes contact elements stamped from a metal plate by a press machine and press-fitted into through holes formed in a resinous body, it is difficult to maintain the molding precision of the body, and to prevent the contact elements from short-circuiting, as the pitch of the contact elements array becomes narrow. Accordingly, a connector has been provided which includes a plurality of conductive portions for electric connection formed by plating predetermined surface portions of the resinous body (see, e.g., Japanese Unexamined Patent Publication (Kokai) No. 2-297880). This type of connector having plated conductive portions can facilitate the reduction of the weight of the connector and can simplify a high-density arrangement of the conductive portions on the body surface. However, simply forming the plated conductive portions on the body surface may make it difficult to ensure sufficient contact pressure required for the conducting contact points of the connector. That is, in this structure, the contact pressure is affected by the molding precision of the resinous body and, therefore, contact reliability may be deteriorated unless the body is precisely molded so as to permit male and female connectors to be constantly tightly fitted with each other without substantial looseness.

Japanese Unexamined Patent Publication (Kokai) No. 3-173080 discloses a connector including protrusions integrally formed on an electrically insulating body, the protrusions being deposited on the surfaces thereof with electrically conducting layers to constitute contact elements. In this connector, the protrusions are fixedly supported in a cantilever manner on the body and, thereby, a desired elasticity or spring action is imparted to the plated contact elements. According to this connector, it is possible to ensure sufficient contact pressure for the.conducting contact points of the contact elements, even when the body and the protrusions have dimensional tolerances.

In the above connector having the integrally-formed cantilever contact elements, a lack of mechanical strength of the protrusions forming the contact elements may result in a relatively easy breakage of the contact elements, when an external force is inadvertently applied on the distal ends of the contact elements or when the connector is roughly connected or disconnected with a mating counterpart connector. Therefore, it is required that the protrusions are formed with sufficient thicknesses to maintain a desired mechanical strength and, consequently, it becomes difficult to establish the high density arrangement of the contact elements.

SUMMARY OF THE INVENTION

It is, therefore an object of the present invention to provide a connector having a contact element formed integrally with a body and which can maintain a mechanical strength of the contact element against an external force and can permit the high density arrangement of the contact element.

Another object of the present invention is to provide a method, of producing a so-structured connector, which can enable low-cost and high-precision manufacturing of a high-density, light and small connector.

In order to accomplish the above objects, the present invention provides a connector comprising an electrically insulating body; and at least one contact element provided in the electrically insulating body, the contact element including a protrusion integrally formed on the electrically insulating body and an electrically conducting layer deposited on a surface of the protrusion; wherein the at least one contact element is fixedly supported at opposite ends thereof on the electrically insulating body to exert elasticity.

In this connector, the electrically insulating body may include a bottom wall and a mutually opposed pair of side walls extending uprightly from the bottom wall, and the at least one contact element may be a plurality of contact elements protruding from at least one of the opposed surfaces of the side walls.

The connector may further comprise a plurality of electrically conducting terminals formed on a surface of the bottom wall facing away from the opposed surfaces of the side walls, each of the electrically conducting terminals being individually connected to the electrically conducting layer of each of the contact elements.

In this arrangement, the side walls may be provided with openings located respectively adjacent to the contact elements, and the electrically conducting layer of each of the contact elements may be connected to a corresponding one of the electrically conducting terminals through a corresponding one of the openings.

Each of the openings may be defined at a projected region of each of the contact elements on at least one of the opposed surfaces of the side walls.

Also, each of the contact elements may extend in a convexly curved manner on at.least one of the opposed surfaces of the side walls.

Further, the plurality of contact elements may be respectively formed on the opposed surfaces of the side walls to constitute two contact-element arrays.

Also, the electrically conducting layer may be formed over an entire surface of the protrusion.

The present invention further provides a method, of producing a connector, comprising molding a primarily molded body including at least one protrusion; molding a secondarily molded body on the primarily molded body to form an electrically insulating body in which the at least one protrusion is integrally formed and fixedly supported at opposite ends thereof on the electrically insulating body, the secondarily molded body partially covering the primarily molded body except for a surface of the at least one protrusion; and depositing an electrically conducting layer on the surface of the at least one protrusion.

In this method, the depositing step may include subjecting the electrically insulating body and the at least one protrusion to a plating process.

This method may further comprise, before molding the secondarily molded body, pre-treating the primarily molded body to be adaptable to the plating process.

Also, the primarily molded body may be molded to include a bottom wall and a mutually opposed pair of side walls extending uprightly from the bottom wall, the at least one protrusion may be a plurality of protrusions protruding from at least one of the opposed surfaces of the side walls, and the secondarily molded body may be molded to cover at least a part of the bottom wall and the side walls.

This method may further comprise, simultaneously to the depositing step, depositing an electrically conducting layer on a surface of the bottom wall facing away from the opposed surfaces of the side walls to form a plurality of electrically conducting terminals, each of the electrically conducting terminals being individually connected to the electrically conducting layer formed on each of the protrusions.

Also, the primarily molded body may be molded to be provided with openings in the side walls, located respectively adjacent to the contact elements, and the electrically conducting layer formed on each of the protrusions may be connected to a corresponding one of the electrically conducting terminals through a corresponding one of the openings.

BRIEF DESCRIPTION OF THE DRAWINGS

The above and other objects, features and advantages of the present invention will become more apparent from the following description of preferred embodiments in connection with the accompanying drawings, in which.

DETAILED DESCRIPTION OF THE PREFERRED EMBODIMENTS

Figure 1:
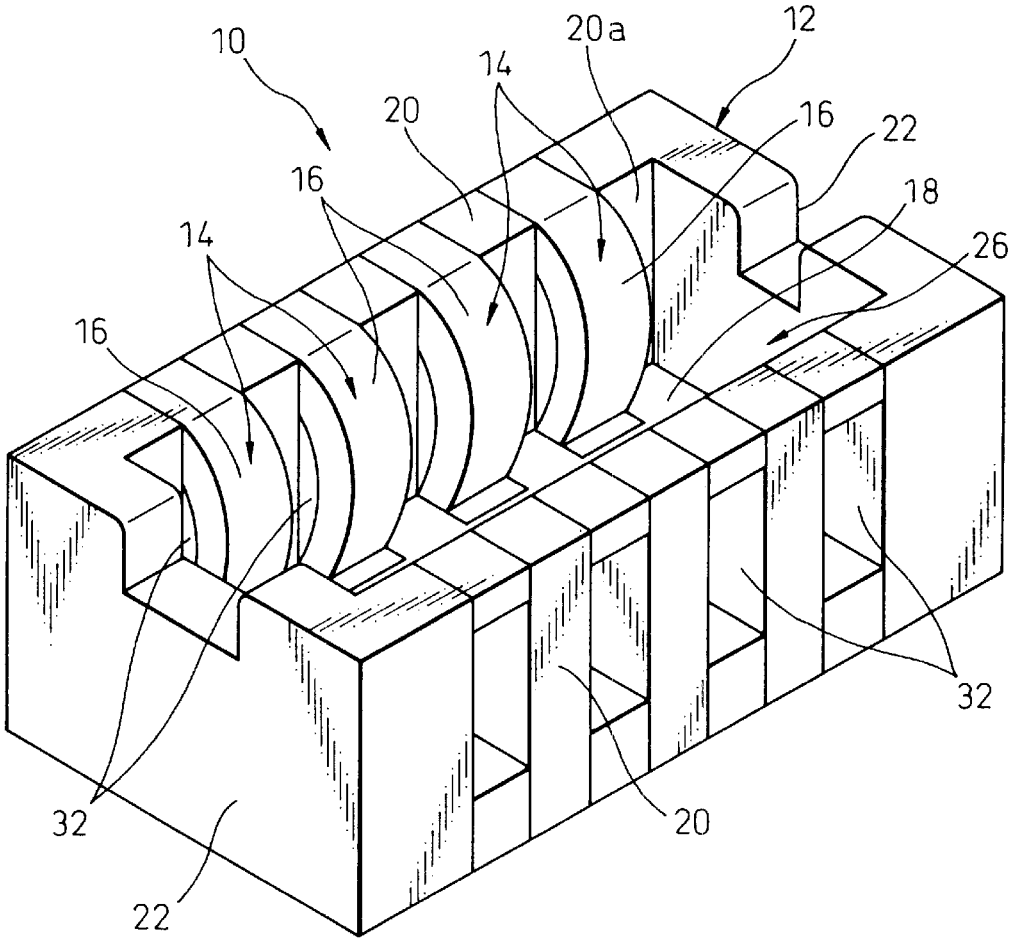
FIG. 1 is a perspective view of a connector according to an embodiment of the present invention.
Figure 2:
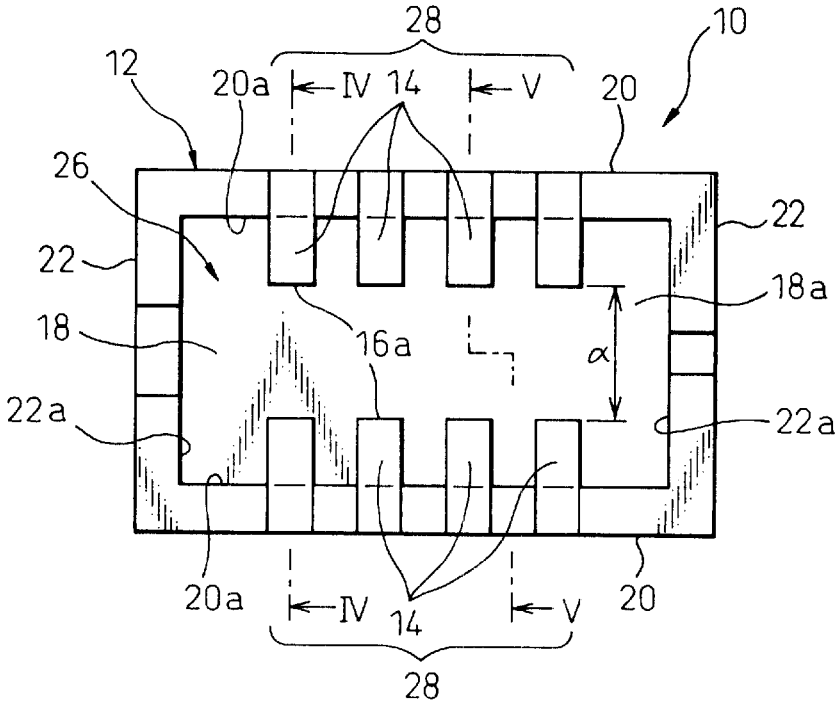
FIG. 2 is a top plan view of the connector of FIG. 1.
Figure 3:
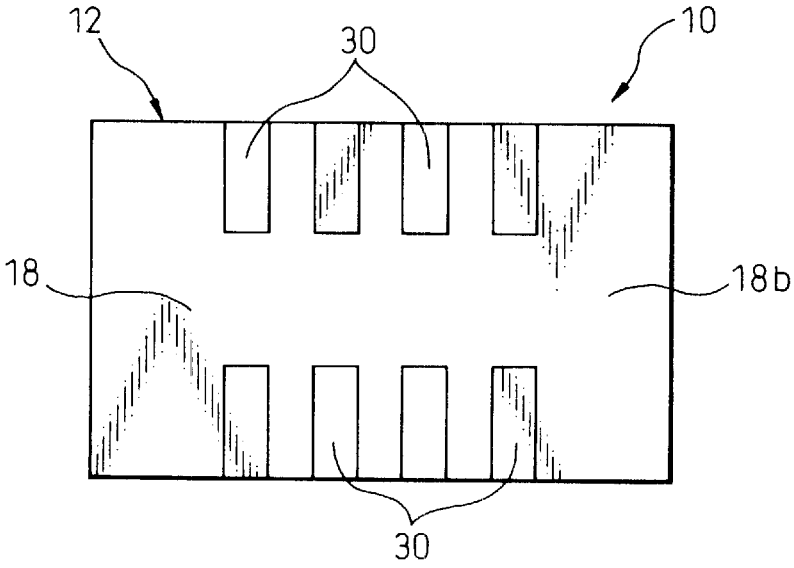
FIG. 3 is a bottom plan view of the connector of FIG. 1.

Referring to the drawings, wherein the same or similar components are denoted by the common reference numerals, FIGS. 1 to 3 show a connector 10 according to an embodiment of the present invention. The connector 10 of this embodiment has a jack or female structure. However, the present invention may be applied to a plug or male type connector.

The connector 10 has an integrally molded structure, and includes an electrically insulating body 12 and a plurality of contact elements 14 formed integrally with the body 12. The contact elements 14 are formed by depositing electrically conducting layers 16 on the respective surfaces of plural protrusions integrally formed on the body 12, through a plating step in a manufacturing process of the connector 10 as described later. The body 12 and the protrusions may be made from a resinous material in a similar way to insulators of general connectors.

The body 12 includes a flat-plate bottom wall 18 with generally rectangular upper and lower surfaces 18*a*, 18*b*, a pair of major side walls 20 extending generally vertically from the upper surface 18*a* of the bottom wall 18 and located along the opposite longitudinal edges of the latter, and a pair of auxiliary side walls 22 extending generally vertically from the upper surface 18*a* between the opposite major side walls 20 and located along the opposite transverse edges of the bottom wall 18. The bottom wall 18, the major side walls 20 and the auxiliary side walls 22 are integrally joined with each other. The major side walls 20 have opposed surfaces 20*a* arranged generally in parallel with each other. The auxiliary side walls 22 also have opposed surfaces 22*a* arranged generally in parallel with each other. The upper surface 18*a* of the bottom wall 18, the opposed surfaces 20*a* of the major side walls 20 and the opposed surfaces 22*a* of the auxiliary side walls 22 cooperate with one another to define a receptacle portion 26 for receiving a mating counterpart connector 24 having a plug or male structure.

The plural contact elements 14 are formed so as to protrude into the receptacle portion 26 from each of the opposed surfaces 20*a* of the major side walls 20, and are arranged in parallel, at regular intervals along each opposed surface 20*a*, so as to constitute two contact-element arrays 28 facing each other. In the alternative embodiment, the contact elements 14 may be formed on one major side wall 20, or the two contact-element arrays 28 may be constituted as staggered arrays. Also, the connector according to the present invention may include at least one contact element formed as a protrusion integrally molded on an insulation body in a manner described later.

In the connector 10, each of the contact elements 14 extends in a convexly curved manner on the opposed surface 20*a* of the corresponding major side wall 20, and is integrally joined at one end thereof to an upper end region of the major side wall 20 and at the other end thereof to the bottom wall 18 in close proximity to the lower end of the major sidewall 20. In this manner, each contact element 14 is fixedly supported at both ends thereof on the body 12, and can exert an elasticity or a spring action at the curved section thereof.

In the bottom wall 18 of the body 12, a plurality of electrically conducting terminals 30 are formed on a lower surface 18*b* facing away from the opposed surfaces 20*a* of the major side walls 20, the conducting terminals 30 being individually connected to the electrically conducting layers 16 of the contact elements 14. The conducting terminals 30 are arranged at regular intervals identical to those of the contact elements 14 along the opposite longitudinal edges of the bottom wall 18. Openings 32 are formed in the major side walls 20 of the body 12 in such a manner as to be adjacent to the respective contact elements 14. Each of the openings 32 is defined at a projected region of each contact element 14 on the opposed surface 20*a* of the major side wall 20. The conducting layers 16 of the contact elements 14 are respectively connected through the openings 32 to the corresponding conducting terminals 30.

It is required in the present invention that the conducting layer 16 of each contact element 14 is provided at least in a region around the vertex of the curved section of the contact element 14. Particularly, it is advantageous that, as illustrated, the conducting layer 16 is deposited on the whole surface of the protrusion described later, from the viewpoint of improving the reliability in the electric connection between the conducting layer 16 and the conducting terminal 30.

Figure 4:
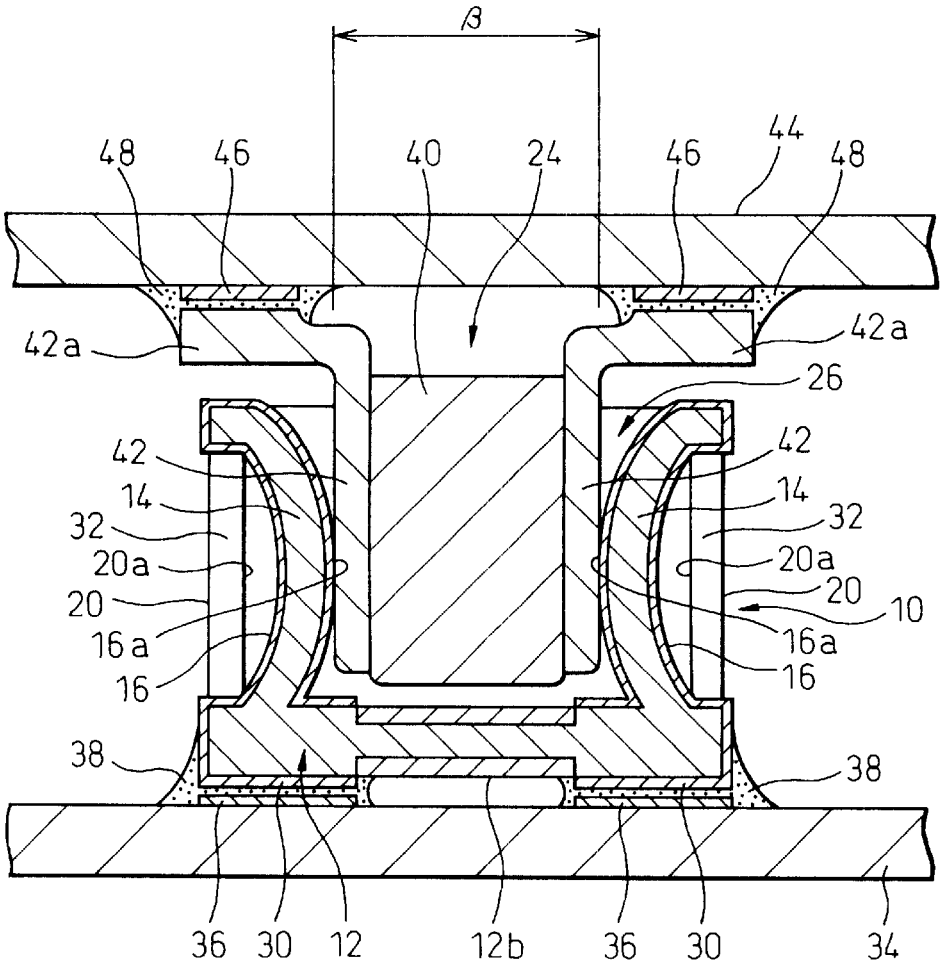
FIG. 4 is a vertical section showing the mutually fitting state of the connector of FIG. 1 and a mating counterpart connector.

Referring to FIG. 4, the connector 10 is mounted on the surface of a circuit board 34 with the lower surface 12*b* of the body 12 facing toward the surface of the circuit board 34. At the time of mounting, the conducting terminals 30 formed on the lower surface 12*b* of the body 12 are placed on and in alignment with plural electrode pads 36 formed on the surface of the circuit board 34, and are secured thereto by solder 38. In this state, the conducting layers 16 of the contact elements 14 of the connector 10 are individually connected to the electrode pads 36 on the circuit board 34.

A mating counterpart connector 24, to which the connector 10 can be connected, includes, e.g., an electrically insulating body 40, and a plurality of contact elements 42 stamped by a press machine and secured to the body 40 in an arrangement corresponding to the contact elements 14 of the connector 10. The connector 24 is mounted on the surface of a circuit board 44 while the lead parts 42*a* of the stamped contact elements 42 are placed on and in alignment with plural electrode pads 46 formed on the surface of the circuit board 44 and are secured thereto by a solder 48. The other type of mating counterpart connector, to which the connector 10 can be connected, may be used for the connector 24, which connector includes a plurality of conductive portions for electric connection formed by plating on predetermined portions on the surface of an electrically insulating body.

When the connector 10 is connected to the connector 24, the body 40 of the connector 24 is inserted into the receptacle portion 26 of the connector 10 while permitting each contact element 14 of the connector 10 to come into sliding contact with each corresponding contact element 42 of the connector 24. In this arrangement, a minimum.distance a (FIG. 2) between the mutually opposed contact elements 14 of the connector 10, when not subject to any load, is selected to be smaller by a desired amount than a maximum distance β (FIG. 4) between the outer surfaces of the contact elements 42 placed on the opposite sides of the connector 24. As a result, each contact element 14 of the connector 10 is resiliently deflected with the opposite ends thereof being fixedly supported, as the body 40 of the connector 24 enters into the receptacle portion 26 of the connector 10. In this manner, when the connection is completed, the contact elements 14 of the connector 10 are respectively brought into contact, at the portions 16*a* of the conducting layers 16 near the vertexes of the curved sections, with the contact elements 42 of the connector 24 to provide good conductivity under sufficient contact pressure.

According to the connector 10, as described above, the contact elements 14 integrally formed on the body 12 can exhibit an elasticity or spring action at the curved sections thereof, so that, even when the body 12 and the contact elements 14 have dimensional tolerances, it is possible to ensure sufficient contact pressure required for the conducting points, i.e., the conducting layer portions 16*a*, of the contact elements 14 during a connected state with the mating counterpart connector 24, by selecting the minimum distance a between the contact elements 14 to be sufficiently smaller than the maximum distance β between the contact elements 42. Further, in the connector 10, the contact elements 14 are fixedly supported at their opposite ends on the body 12, so that each contact element 14 can stably exert excellent elasticity or spring action compared to a contact with a cantilever structure, and that the breakage of the contact elements 14 can be effectively prevented even when an external force is inadvertently applied on the contact elements 14 or when the connector 10 is roughly connected or disconnected with the mating counterpart connector 24. As a result, it becomes possible to decrease the thickness of each contact element 14 while maintaining the mechanical strength of the contact element 14 against the external force, and to permit the high density arrangement of the contact elements 14 in the body 12. Therefore, when the connector 10 is used as a board connector, the size and weight of electronic equipment can be effectively reduced.

The method of producing the connector 10 having the above construction will be described below with reference to FIGS. 5A to 6C.

Figure 5A:
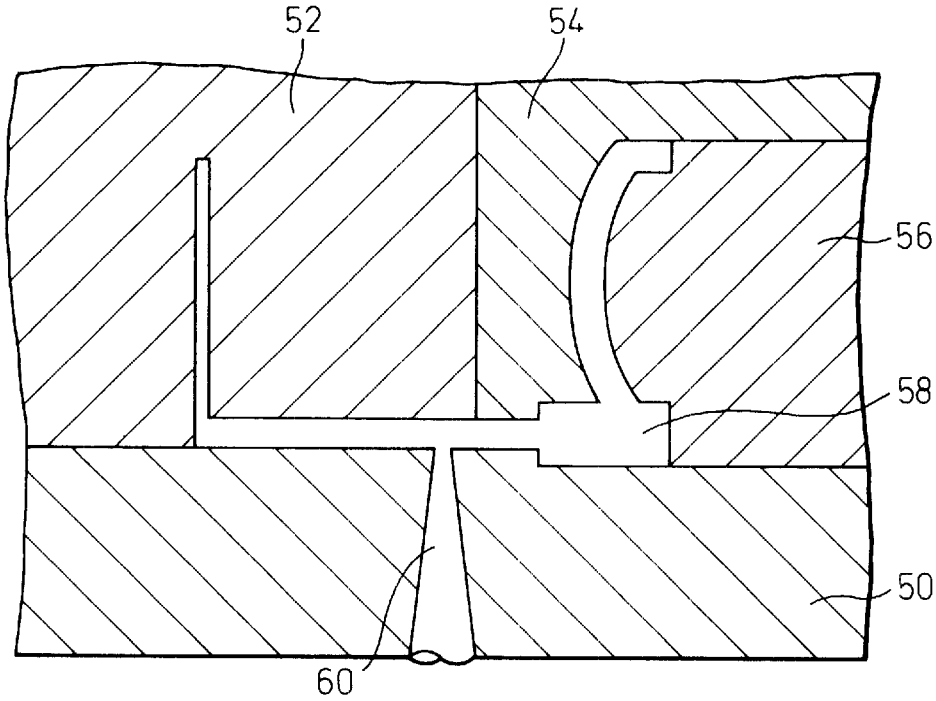
FIG. 5A is a sectional view showing a primary mold used for a method of producing the connector of FIG. 1.
Figure 6A:
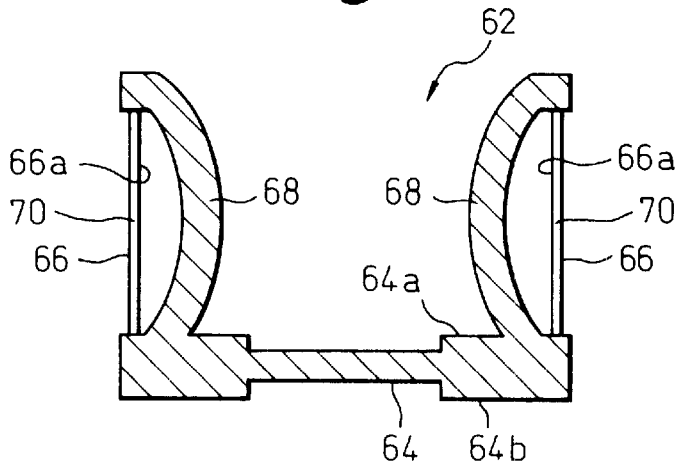
FIG. 6A is a sectional view showing the primarily molded body formed through one step of the producing method.

As shown in FIG. 5A, a fixed mold 50, a first movable mold 52, a second movable mold 54 and a plurality of slide cores 56 (only one core 56 is shown) are combined together so as to assemble a primary mold having a cavity 58. Then, a molten resinous material is poured into the cavity 58 through a gate 60 formed in the fixed mold 50 and is solidified therein, whereby a primarily molded body 62 is integrally molded as shown in FIG. 6A. The primarily molded body 62 is preferably made of a material meeting the required level of moldability, elasticity, etc., and liquid crystal plastic (LCP) or polyethersulfone (PES) may be used as a preferred material. A material permitting a plated layer to be deposited on the surface of the molded body is also advantageously selected.

The primarily molded body 62 thus obtained includes a bottom wall 64 with generally rectangular upper and lower surfaces 64*a*, 64*b*, a pair of side walls 66 extending generally vertically from the upper surface 64*a* of the bottom wall 64 and located along the opposite long edges of the latter, the side walls 66 having opposed surfaces 66*a* generally in parallel with each other, and a plurality of protrusions 68 protruding from each of the opposed surfaces 66*a* of the side walls 66. The bottom wall 64, the side walls 66 and the protrusions 68 are integrally joined with each other. The plural protrusions 68 are arranged in parallel at regular intervals along each opposed surface 66*a* of the side wall 66, so as to constitute two protrusion arrays facing each other. Each of the protrusions 68 extends in a convexly curved manner on the opposed surface 66*a* of the corresponding side wall 66, and is integrally joined at one end thereof to an upper end region of the side wall 66 and at the other end thereof to the bottom wall 64 in close proximity to the lower end of the side wall 66. Further, openings 70 are formed in the side walls 66 in such a manner as to be adjacent to the respective protrusions 68. Each of the openings 70 is defined at a projected region of each protrusion 68 on the opposed surface 66*a* of the side wall 66.

Figure 5B:
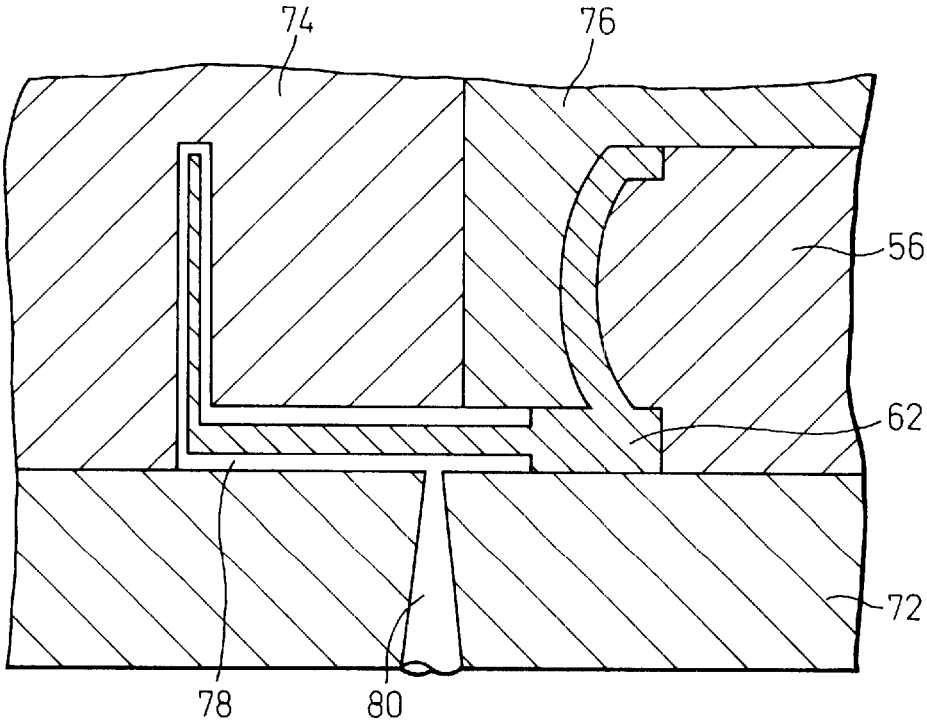
FIG. 5B is a sectional view showing a secondary mold used for the method of producing the connector of FIG. 1, into which a primarily molded body is inserted.
Figure 6B:
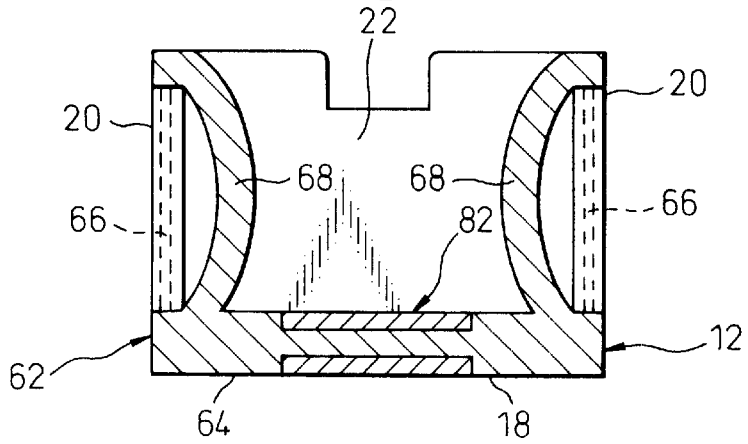
FIG. 6B is, a sectional view showing the secondarily molded body formed on the primarily molded body through another step of the producing method.

Next, the whole surface of the primarily molded body 62 is subjected to a known pre-treatment for plating, such as etching, imparting of catalyst, activation, etc. Then, as shown in FIG. 5B, a fixed mold 72, a first movable mold 74, a second movable mold 76 and the slide cores 56 (only one core 56 is shown) are combined together while containing therein the pre-treated primarily molded body 62, so as to assemble a secondary mold defining a cavity 78 around the desired portion of the primarily molded body 62. Thereafter, a molten resinous material is poured into the cavity 78 through a gate 80 formed in the fixed mold 72 and is solidified therein, whereby a secondarily molded body 82 is integrally molded on the primarily molded body 62 as shown in FIG. 6B. The secondarily molded body 82 is preferably made of LCP. A material making it difficult to deposit a plated layer on the surface of the molded body is also advantageously selected.

The secondarily molded body 82 is so molded as to surround the bottom wall 64 and both side walls 66 while the protrusions 68 of the primarily molded body 62 as well as the predetermined regions of the bottom wall 64 and of the side walls 66, to which the protrusions 68 are joined, are exposed. In this manner, the body 12 including the bottom wall 18, the pair of major side walls 20 and the pair of auxiliary side walls 22 and fixedly supporting the plural protrusions 68 at their respective ends is integrally formed from the above-described resinous materials.

Figure 6C:
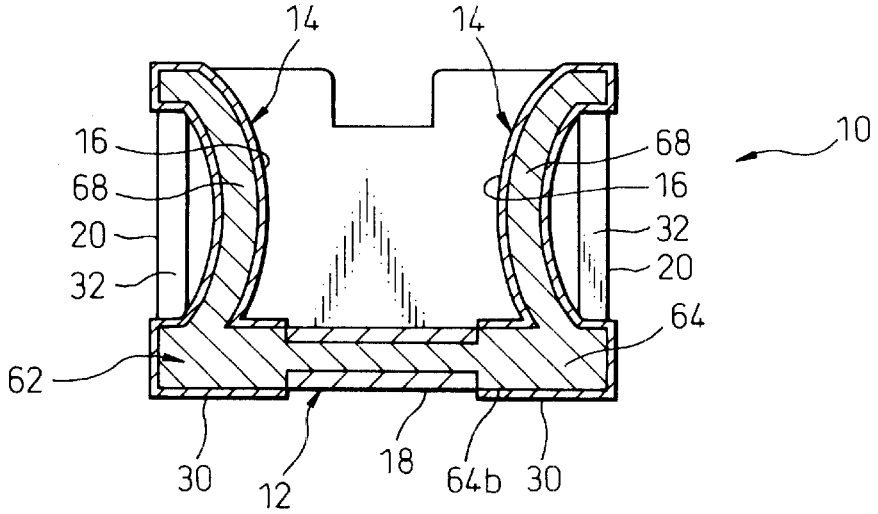
FIG. 6C is a sectional view showing the molded connector of FIG. 1 formed through further step of the producing method.

Next, as shown in FIG. 6C, an electroless copper plating is applied on the surfaces of the body 12 and of the protrusions 68, and thereafter a nickel primary coat and a gold plating are applied thereon. In these plating steps, deposits or metal skins are formed only on the exposed surfaces of the pre-treated primarily molded body 62. In this manner, the electrically conducting layers 16 are formed or deposited on the whole surfaces of the plural protrusions 68, whereby the contact elements 14 are configured. Simultaneously, the deposits or metal skins formed on the predetermined regions of the bottom wall 64 and of the side walls 66, to which the protrusions 68 are joined, configure the electrically conducting terminals 30 located on the lower surface 64*b* of the bottom wall 64 of the primarily molded body 62, facing away from the opposed surfaces 66*a* of the side walls 66, the conducting terminals 30 being individually connected to the respective conducting layers 16 formed on the protrusions 68. Each conducting terminal 30 is connected to each conducting layer 16 on the protrusion 68 through the corresponding opening 32. In this manner, the connector 10 is manufactured.

According to the above-described production method of the present invention, the electrically conductive portions including the contact elements 14 can be easily and correctly formed on the body 12 through the plating process, and the employment of a two-material molding process can simplify the plating process. Consequently, it is possible to highly precisely produce, at low cost, a high-density, light and small connector.

Figure 7:
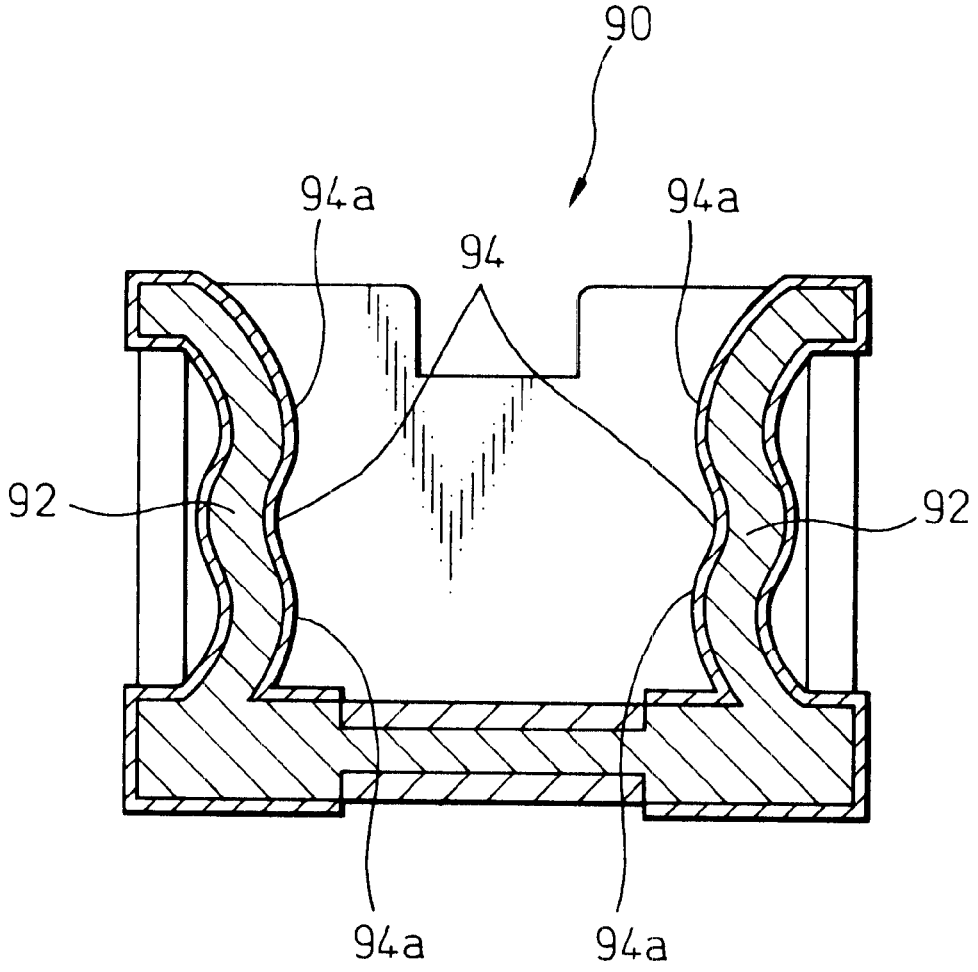
FIG. 7 is a sectional view showing a modification of the inventive connector.

FIG. 7 shows a connector 90 according to a modified embodiment of the present invention. The connector 90 includes contact elements 92 each of which is curved to possess vertexes at two positions selected along the length thereof. According to this structure, each contact element 92 can come into conductive contact with a contact element of a mating counterpart connector at two vertex portions 94*a* on an electrically conducting layer 94, so that the reliability of connection can be further enhanced.

The experiment described below was performed to clarify the advantageous effects of the present invention.

The connector 10 of FIG. 1 was integrally molded from LCP according to the above-described production method. After that, gold plating is deposited on the electrically conductive portions of the connector 10. The characteristic properties and the design target values of the connector 10 thus produced was as follows: Temperature range for use . . . −40° C. to 85° C. Max. allowable current . . . DC 0.3A Max. allowable voltage . . . AC 200V/DC 300V Contact resistance . . . 40 mΩ or less Insulation resistance . . . 100 MΩ or over Dielectric strength AC 500V (one min.) Connection/disconnection life . . . 30 times The connector 10 with the above constitution exhibited a good electrically connecting function under a stable contact pressure even after the connection and disconnection were repeated.

While the invention has been particularly shown and described with reference to preferred embodiments thereof, it will be understood by those skilled in the art that various changes and modifications may be made without departing from the spirit and scope of the following claims.

What is claimed is:

1. A connector comprising:

an electrically insulating body including a bottom wall; and at least one contact element provided in said electrically insulating body, said contact element including a protrusion unitary with said electrically insulating body and an electrically conducting layer deposited on a surface of said protrusion;

wherein said at least one contact element is fixedly supported at opposite ends thereof on said electrically insulating body to exert elasticity, wherein said electrically insulating body further includes a mutually opposed pair of side walls extending uprightly from said bottom wall, and wherein said at least one contact element is a plurality of contact elements protruding from at least one of opposed surfaces of said side walls into a slot between the side walls.

2. The connector of claim 1, further comprising a plurality of electrically conducting terminals formed on a surface of said bottom wall facing away from said opposed surfaces of said side walls, each of said electrically conducting terminals being individually connected to said electrically conducting layer of each of said contact elements.

3. The connector of claim 2, wherein said side walls are provided with openings located respectively adjacent to said contact elements, and wherein said electrically conducting layer of each of said contact elements is connected to a corresponding one of said electrically conducting terminals through a corresponding one of said openings.

4. The connector of claim 3, wherein each of said openings is defined at a projected region of each of said contact elements on at least one of said opposed surfaces of said side walls.

5. The connector of claim 1, wherein each of said contact elements extends in a convexly curved manner on at least one of said opposed surfaces of said side walls.

6. The connector of claim 1, wherein said plurality of contact elements are respectively formed on said opposed surfaces of said side walls to constitute two contact-element arrays.

7. The connector of claim 1, wherein said electrically conducting layer is formed over an entire surface of said protrusion.

8. A method of producing a connector, comprising:

molding a primarily molded body including at least one protrusion;

molding a secondarily molded body on said primarily molded body to form an electrically insulating body in which said at least one protrusion is integrally molded and unitary with, and fixedly supported at opposite ends thereof on, said electrically insulating body, said secondarily molded body partially covering said primarily molded body, except for a surface of said at least one protrusion which remains exposed; and depositing an electrically conducting layer on said exposed surface of said at least one protrusion.

9. The method of claim 8, wherein said depositing step includes subjecting said electrically insulating body and said at least one protrusion to a plating process.

10. The method of claim 9, further comprising, before molding said secondarily molded body, pre-treating said primarily molded body to be adaptable to said plating process.

11. The method of claim 8, wherein said primarily molded body is molded to include a bottom wall and a mutually opposed pair of side walls extending uprightly from said bottom wall, wherein said at least one protrusion is a plurality of protrusions protruding from at least one of opposed surfaces of-said side walls, and wherein said secondarily molded body is molded to cover at least a part of said bottom wall and said side walls.

12. The method of claim 11, further comprising, simultaneously with said depositing step, depositing an electrically conducting layer on a surface of said bottom wall facing away from said opposed surfaces of said side walls to form a plurality of electrically conducting terminals, each of said electrically conducting terminals being individually connected to said electrically conducting layer formed on each of said protrusions.

13. The method of claim 12, wherein said primarily molded body is molded to be provided with openings in said side walls, located respectively adjacent to said contact elements, and wherein said electrically conducting layer formed on each of said protrusions is connected to a corresponding one of said electrically conducting terminals through a corresponding one of said openings.

* * * * *

UNITED STATES PATENT AND TRADEMARK OFFICE

CERTIFICATE OF CORRECTION

PATENT NO. : 6,575,769 B1
DATED : June 10, 2003
INVENTOR(S) : Masayuki Takeuchi et al.

It is certified that error appears in the above-identified patent and that said Letters Patent is hereby corrected as shown below:

Column 9,
Line 6, change “of-said” to -- of said --.

Signed and Sealed this

Fourteenth Day of October, 2003

JAMES E. ROGAN
*Director of the United States Patent and Trademark Office*